United States Patent [19]

Nielsen

[11] Patent Number: 4,534,709

[45] Date of Patent: Aug. 13, 1985

[54] WATER DISPLACEMENT MERCURY PUMP

[75] Inventor: Marshall G. Nielsen, Woodside, Calif.

[73] Assignee: United States of America as represented by the United States Department of Energy, Washington, D.C.

[21] Appl. No.: 602,243

[22] Filed: Apr. 20, 1984

[51] Int. Cl.[3] ..... F04F 11/00

[52] U.S. Cl. ..... 417/65; 417/92

[58] Field of Search ..... 417/92, 65, 98, 99, 417/107, 116, 118, 119, 120

[56] References Cited

U.S. PATENT DOCUMENTS

| | | | |
|---|---|---|---|
| 128,623 | 7/1872 | Hofmann | 417/118 |
| 422,219 | 2/1890 | Jaeger | 417/99 |
| 751,323 | 2/1904 | Moran et al. | 417/118 |
| 1,072,562 | 9/1913 | Berg | 417/118 |
| 1,736,188 | 11/1929 | Daesen et al. | 417/118 |
| 2,273,993 | 2/1942 | Rockwood, Jr. | 417/99 |
| 2,630,249 | 3/1953 | Bryant et al. | 417/118 |

FOREIGN PATENT DOCUMENTS

| | | | |
|---|---|---|---|
| 75397 | 5/1894 | Fed. Rep. of Germany | 417/118 |
| 726399 | 3/1932 | France | 417/118 |
| 15856 | of 1888 | United Kingdom | 417/99 |
| 931985 | 5/1982 | U.S.S.R. | 417/118 |

OTHER PUBLICATIONS

*Perry's Chemical Engineer's Handbook,* 5th Edition, Section 6, p. 15.

*Primary Examiner*—William L. Freeh
*Assistant Examiner*—Paul F. Neils
*Attorney, Agent, or Firm*—Allen F. Westerdahl; Judson R. Hightower

[57] ABSTRACT

A water displacement mercury pump has a fluid inlet conduit and diffuser, a valve, a pressure cannister, and a fluid outlet conduit. The valve has a valve head which seats in an opening in the cannister. The entire assembly is readily insertable into a process vessel which produces mercury as a product. As the mercury settles, it flows into the opening in the cannister displacing lighter material. When the valve is in a closed position, the pressure cannister is sealed except for the fluid inlet conduit and the fluid outlet conduit. Introduction of a lighter fluid into the cannister will act to displace a heavier fluid from the cannister via the fluid outlet conduit. The entire pump assembly penetrates only a top wall of the process vessel, and not the sides or the bottom wall of the process vessel. This insures a leakproof environment and is especially suitable for processing of hazardous materials.

4 Claims, 3 Drawing Figures

WATER DISPLACEMENT MERCURY PUMP

CONTRACT STATEMENT

The U.S. Government has rights in this invention pursuant to Subcontract No. AXC-1997-W with Bechtel National, Inc. under Contract No. DE-AC09-76SR00001 between the U.S. Department of Energy and E. I. DuPont de Nemours & Co.

BACKGROUND OF THE INVENTION

1. Field of the Invention

The present invention relates to a new water displacement mercury pump.

2. Discussion of Background and Prior Art

Various types of pumps are well-known in the prior art. In one type of prior art, a tube is inserted into a liquid to be pumped, and a vacuum applied to another end of the tube thus drawing up the liquid. A drawback of this type of prior art suction pump, is that the height of a column of liquid drawn up is limited by the ambient air pressure acting upon a surface of the liquid. Thus, suction pumps even for water are limited to a certain height beyond which suction pumps fail to operate and cavitation occurs. With a heavier liquid, such as mercury, a much smaller liquid column can be supported by the ambient air pressure.

In a second type of prior art pump, a pump assembly is placed at the bottom of a reservoir of liquid. Power lines must be supplied to the pump, as well as a fixed support. A disadvantage of this type of pump is that it must be liquid-proof, since liquid leaking into a motor of such a pump would tend to damage it. Furthermore, in the case where the liquid is mercury, the mercury itself may tend to damage various pump parts and react therewith.

Also known in the art is the conventional laboratory device called an "acid egg", shown in *Perry's Chemical Engineers Handbook,* 5th Edition, Section 6, page 15. The "acid egg" reference shows an egg-shaped body having a pipe extending from the top wall into the body so as to receive liquid acid collected on the bottom of the body. Air introduced under pressure from another inlet displaces the acid up into the pipe and out of the egg. However, the "acid egg" differs from the present invention, and suffers the drawback of being incapable of operation in a chemical reactor vessel to extract liquid settling to the bottom of the vessel during a chemical reaction in the vessel.

SUMMARY OF THE INVENTION

An object of the present invention is to provide an improved water displacement mercury pump, which is selectively operable to displace mercury from a reservoir, the reservoir being selectively openable and closable to admit mercury or to be pressurized as desired.

A further object of the present invention is to provide a removable water displacement mercury pump, which is used in a situation where no inlet or outlet lines may pass through the bottom or side wall of said reservoir or process vessel.

It is a still further object of the present invention to provide an improved water displacement mercury pump having a pressurizable reservoir, which is located within a mercury sump pit, the mercury sump pit not ordinarily being capable of withstanding high pressure.

It is another further object of the present invention to provide an improved water displacement mercury pump having a normally closed valve which encloses a mercury reservoir, a water inlet line to the reservoir, and a mercury outlet line passing through the top of the reservoir and also out of the top of a process vessel within which the water displacement mercury pump is installed.

It is a further object of the present invention to provide an improved water displacement mercury pump having a reaction process vessel within which has been inserted through a top opening a water displacement mercury pump which is generally elongated, a water inlet line passing through the top of the reaction vessel and pump assembly, the inlet water line terminating by passage through a top wall of the mercury pressure cannister, a valve operable by air pressure to open and which valve seats against an aperture in a top wall of the pressure cannister to selectively close it for a pressuring operation, and a mercury outlet line passing through the top wall of the pressure cannister, the mercury outlet line terminating at a point close to the very bottom of the mercury pressure cannister, with the other end of the mercury outlet line extending through a top wall of the reaction vessel and pump assembly; the valve being used to seat in the opening in the pressure cannister while pressurized water is injected into the water inlet line so as to create sufficient pressure to drive mercury from the bottom of the pressure cannister into the inlet of the mercury outlet line and completely out of the line under the action of sufficient water pressure.

It is another further object of the present invention to provide a water displacement mercury pump which is removable from a reaction vessel while reactions are ongoing or while fluid remains in the reaction vessel, through the use of an overhead crane assembly to remove an inserted mercury pressure cannister as well as all related water and mercury lines as well as a valve stem, without damage to either the process vessel or to the water displacement mercury pump itself.

Reference will now be made in detail to the present preferred embodiment of the invention, which is illustrated in the accompanying drawings.

DETAILED DESCRIPTION OF THE INVENTION

Figure 1:
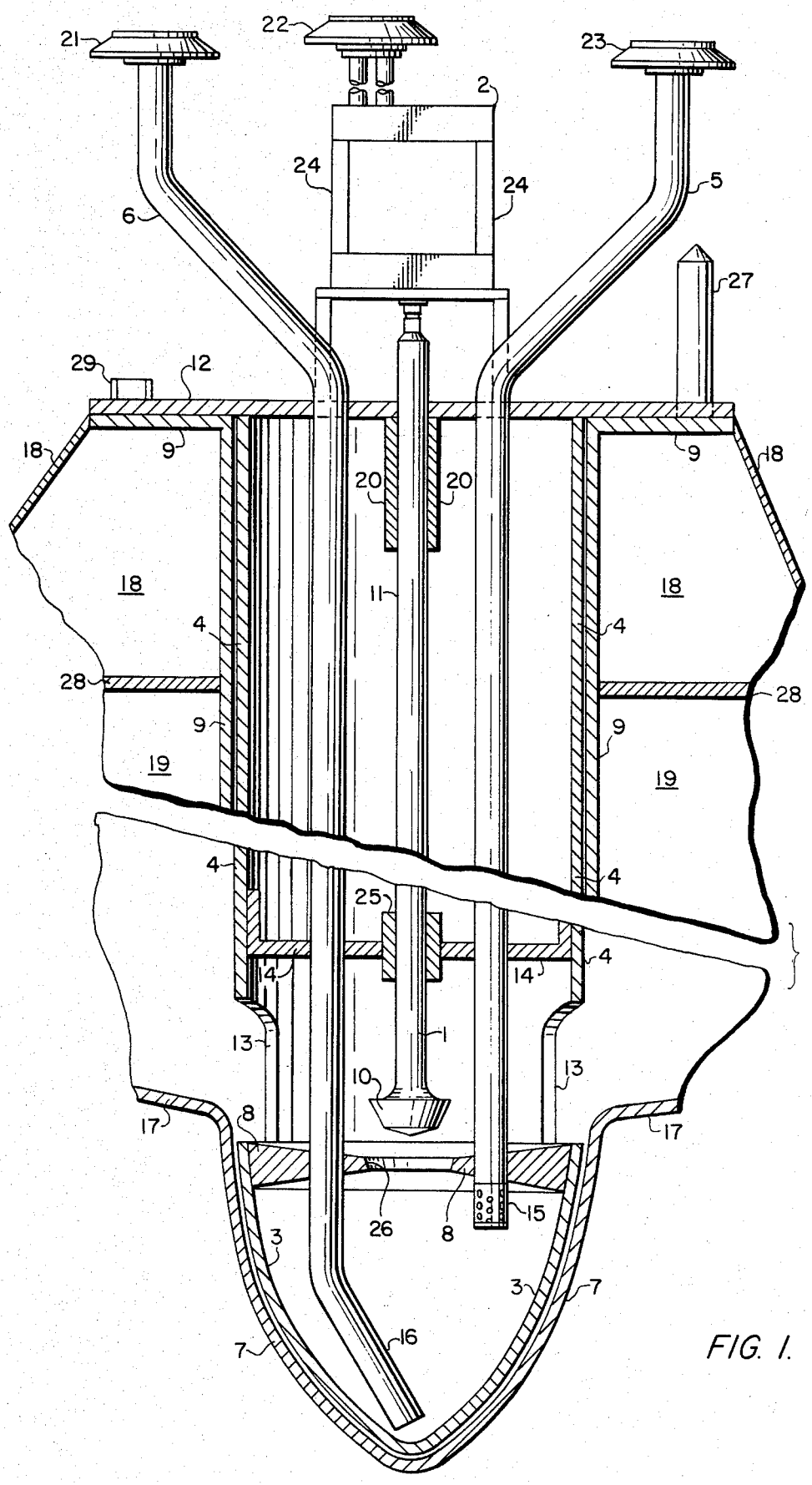
FIG. 1 shows a side view partially in section of both the top and the bottom portions of the water displacement mercury pump of the present invention.

FIG. 1 is a side elevational view of a water displacement mercury pump assembled together with a process vessel 19. Portions of both the process vessel 19 and the water displacement mercury pump are shown in cross-section. A positive closure valve 1 is shown in FIG. 1 having a closure valve head 10 which seats in a valve seat 26 during normal operation.

The valve seat 26 is formed in a pressure cannister top closure wall 8, which is fixedly attached to a pressure cannister 3. The pressure cannister 3 receives liquid mercury and is sufficiently sturdy and strong so as to withstand very high pressures which pressures are sufficient to drive a column of mercury up out of the pump assembly.

The positive closure valve 1 is openable by an air cylinder 2 which is fixedly attached above a pump top closure wall 12. The pressure cannister 3 is received within a mercury sump pit 7 and is situated in a shallow depression slightly below the lowermost portion of a process vessel tank bottom wall 17. Thus, mercury produced in the process vessel 19 gravitates toward the shallow depression above the pressure cannister top closure wall 8 due to its very high specific gravity.

The pressure cannister 3 is fixedly attached to a support shaft 4 which is located within the process vessel 19 by a process vessel annular wall tank flange opening 9. The pressure cannister top closure wall 8 is tapered in thickness from the outermost portion to the innermost annular opening which forms the valve seat 26. The valve seat 26 is conically tapered so as to positively seat a closure valve head 10. The closure valve head 10 has a corresponding conical taper, so that during closure the cooperating conical shapes of the closure valve head 10 and the valve seat 26 insure that the closure valve head 10 is properly guided into a leak-resistant seal. Sufficient pressure on the closure valve head 10 by the positive closure valve 1 due to pressure exerted by the air cylinder 2 insures that a leak-resistant, tight fit is achieved.

The pressure cannister top closure wall 8 is penetrated by two pipes, a cannister pressurizing line 5 and a mercury outlet line 6. The cannister pressurizing line 5 is used to introduce water under high pressure, for example 300 p.s.i., into the pressure cannister 3 when mercury is present in the pressure cannister 3. With the closure valve head 10 in closed seating position against the valve seat 26, mercury is forced upward through the mercury outlet line 6.

The pressure cannister 3 is used to withstand the high pressures since it is, in this case, not desirable to make the mercury sump pit 7 sufficiently strong to withstand such pressures and because it is desirable that the water displacement mercury pump of the present invention be removable from the mercury sump pit 7 and from the process vessel 19 for repair or service as needed. Therefore, it is an important characteristic of the present invention that the process vessel 19 not be permanently fixed to the pump assembly. A cannister pressurizing line coupling flange 23 is used to provide high pressure water to the cannister pressurizing line 5. A mercury outlet line coupling flange 21 is used to withdraw mercury from the mercury outlet line 6 when mercury is being pumped from the pressure cannister 3. The cannister pressurizing line 5 has a cannister pressurizing line diffuser 15 situated just below the pressure cannister top closure wall 8. The diffuser 15 is required to reduce the incoming water velocity and increase the static pressure so as not to grossly mix the motive water with the mercury being transferred. The mercury outlet line 6 has a mercury line inlet end 16 situated with an open end closely adjacent the bottommost portion of the pressure cannister 3. Thus, when pressure is exerted by the introduction of high pressure water through the cannister pressurizing line 5 and out of the cannister pressurizing line diffuser 15, mercury which has accumulated at the bottom of the pressure cannister 3 is forced into the mercury line inlet end 16 by the high water pressure and upward through the mercury outlet line 6.

The process vessel tank bottom wall 17 is integral with other portions of the process vessel 19. Process vessel 19 is constructed so that it cannot be pressurized above atmospheric pressure. The process vessel 19 is also constructed so that it can receive sludge and formic acid to reduce mercuric compounds to elemental mercury, the elemental mercury then settling to the bottom of the tank as reduction proceeds. Due to the high specific gravity of mercury, the mercury settles at the low point which is atop the mercury sump pit 7. This accumulation of mercury occurs even with constant agitation in the process vessel 19. The pressure cannister 3 which is placed within the mercury sump pit 7 collects the mercury. Nonetheless, although the water displacement mercury pump of the present invention is used in a preferred embodiment for pumping mercury within process vessel 19, the pump of the present invention may be used for any liquid material which is heavier than another material with which it is mingled. And any process may be used to accumulate this heavier liquid and not just the use of formic acid and a sludge as discussed in the above. For example, the pump of the present invention could be used to separate oil from water, or mercury from any other liquid compound or granular solid compound as desired. Moreover, the utility of the present invention is not limited to liquids but may include applications for separating two powders or two granular materials where one has a higher specific gravity than the other and thus would tend to settle to the bottom of a positive closure valve 1. For example, gravel and coal dust could be separated in this fashion if both were sufficiently fine that application of pressure causes them to flow similar to a fluid flow.

The positive closure valve 1 has a closure valve stem 11 which is both supported and guided against lateral movement by a support shaft reinforcing wall 14. The support shaft reinforcing wall 14 has a reinforcing wall valve stem support sleeve 25 fixed integrally therewith. It is the reinforcing wall valve stem support sleeve 25 which actually guides the closure valve stem 11 through longitudinal movement of the closure valve stem 11.

The support shaft 4 is formed as a hollow, cylindrical tube for maximum structural strength. A support shaft aperture 13 is shown formed in the support shaft 4 on both a left- and a right-hand side portion of the support shaft 4 in FIG. 1. Also, a plurality of support shaft apertures 13 are shown also in FIG. 2. Each support shaft aperture 13 permits the passage of reacting process fluids therethrough. Inlet water admitted into the pressure cannister 3, if mixed in a relatively small amount with the contents of the process vessel 19, is not generally harmful to the reaction in the process vessel 19. For example, a process reaction may use sludge, slurry, or formic acid, either separately or in combination. Each support shaft aperture 13 permits the reaction fluids to pass inside the support shaft 4 since the design of the support shaft 4, the associated cannister pressurizing line 5, and mercury outlet line 6 do not require that they be isolated from the reacting process fluids. Some support shaft apertures 13 may be omitted if desired; and the number or shapes of the apertures 13 are not crucial to the operation of the water displacement mercury pump of the present invention.

The cannister pressurizing line 5 and the mercury outlet line 6 are in a preferred embodiment formed of conventional pipe. Stainless steel pipe, or any other type of pipe including plastic pipe may be used so long as it is compatible with the reacting fluids. The cannister pressurizing line 5 and the mercury outlet line 6 are formed of pipe sufficiently thick for the material used so as to withstand the pressures of at least 300 p.s.i. encountered during operation of the pump. Although the cannister pressurizing line 5 and the mercury outlet line 6 are preferably circular pipe, any other cross-sectional pipe may be used. Thus, and cross-sectional shape of pipe may be used which then would require cooperating apertures formed in the appropriate support shaft reinforcing wall 14 and pressure cannister top closure wall 8. The cannister pressurizing line 5 and mercury outlet line 6 are supported at their tops by a pump top closure wall 12. The pump top closure wall 12 has openings formed therein of appropriate shape to receive the cross-sectional shape of each of the cannister pressurizing line 5 and the mercury outlet line 6.

The pump top closure wall 12 has fixed thereto a support shaft annular valve stem guide sleeve 20. The support shaft annular valve stem guide sleeve 20 is used to guide the top of the closure valve stem 11 of the positive closure valve 1 so as to permit only vertical movement up or down therethrough.

Figure 2:
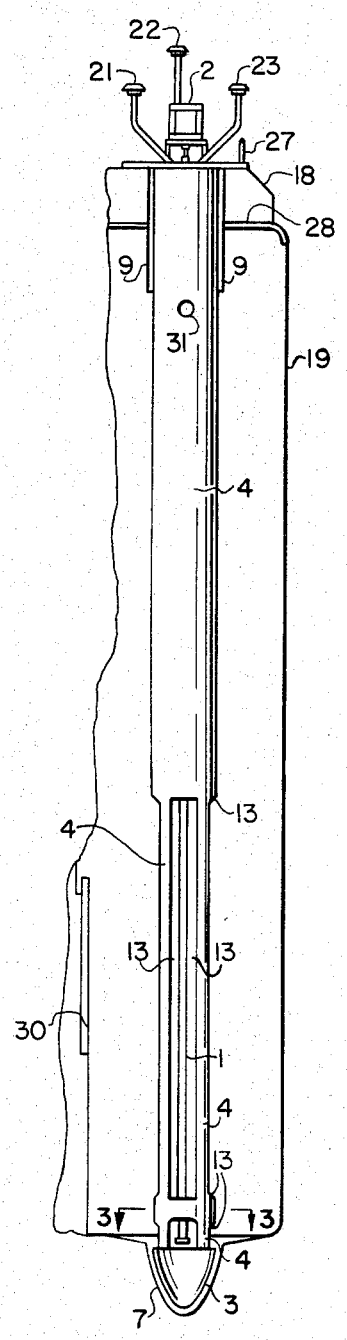
FIG. 2 shows a side view of the water displacement mercury pump in its full length as installed in a larger vessel which is shown in cross-section, the mercury sump pit being shown in a side elevational view at the bottom of the figure.

The pump top closure wall 12 is removable from the process vessel annular wall tank flange opening 9 as shown in FIGS. 1 and 2. In particular, a pump alignment rod 27 is fixed to an outer flange of the process vessel annular wall tank flane opening 9 and is snugly received by an aperture formed in the pump top closure wall 12. Thus, the pump alignment rod 27 serves to align the pump top closure wall 12 with respect to a flange of the process vessel annular wall tank flange opening 9. A nut 29 is shown in FIG. 1 which is used to fixedly attach the pump top closure wall 12 to the process vessel annular wall tank flange opening 9. A plurality of nuts 29 are used, however, only a single one is shown for illustration purposes in FIG. 1.

The process vessel annular wall tank flange opening 9 is connected to the process vessel 19 by a tank flange support wall 18 shown in FIGS. 1 and 2. The tank flange support wall 18 supports the process vessel annular wall tank flange opening 9 and is sufficiently strong to support the weight of the entire pump assembly. In FIG. 1 as well as in FIG. 2, the support shaft 4 is shown as being received within the process vessel annular wall tank flange opening 9. The process vessel annular wall tank flange opening 9 extends from the very top of the process vessel 19 downward and below a tank flange support wall 28 by a distance which is a small fraction of the total process vessel 19 height. This is shown clearly in FIG. 2. The tank flange support wall 28 serves to isolate as well as further strengthen the tank flange support wall 18 and associated pump assembly. Also, the tank flange support wall 28 serves to prevent and further secure the support shaft 4 against lateral movement with respect to the process vessel 19.

A pair of support members 24 are shown in FIG. 1 supporting an air cylinder 2 which is used to operate the positive closure valve 1. The air cylinder 2 in use lifts the positive closure valve 1 so that it is in the position shown in FIG. 1. In a preferred embodiment, the air cylinder used has a 2½ inch bore, a 6 inch stroke, and an iron piston ring Schrader bellows, commercial item no. FLC113223. Nonetheless, air cylinders and supports are standard, commercially available components, and use of any type of air piston or support arrangement is within the scope of the present invention. The top portions of the cannister pressurizing line 5 and the mercury outlet line 6 are shown as being bent away from the air cylinder 2 and then again upward to a vertical direction. The cannister pressurizing line 5 terminates at its uppermost end at the cannister pressurizing line coupling flange 23 which is used to supply pressurized water to the cannister pressurizing line 5. The uppermost end of the mercury outlet line 6 terminates in the mercury outlet line coupling flange 21 which is used to withdraw mercury from the pump assembly.

Nonetheless, the particular configuration shown is not critical to the present invention and is merely a preferred embodiment thereof. The cannister pressurizing line 5 and the mercury outlet line 6 may, for example, terminate in a horizontal pipe portion, or a curved or helical pipe portion as may be desired. Also, although an air cylinder 2 is used, a hydraulic cylinder may be used in its stead.

Furthermore, any means for moving the positive closure valve 1 may be used within the scope of the present invention, including but not limited to a gear and rack assembly, an electric motor, an electromagnetic field, a Coulomb force, or the like.

FIG. 2 is a view partially in section and partially broken away of the entire process vessel 19 of the present invention including the pump assembly of the present invention. The right-hand portion of the process vessel 19 is shown in its entirety while the left-hand portion is partially broken away since this further portion is not necessary to the present invention. The sidewalls of the process vessel 19 are generally in cross-section, as are the walls of the tank flange support wall 18, and the tank flange support wall 28. However, the support shaft 4 is not in cross-section but is rather shown as a side elevational view having a circular opening 31. The circular opening 31 is similar to the support shaft aperture 13 in that it permits fluid and air to pass therethrough.

The mercury sump pit 7 is shown in elevational view, that is, the interior portion having the pressure cannister 3 is not shown in FIG. 2. A dip tube assembly 30 is shown in FIG. 2 schematically, and is used to indicate to an operator the level of mercury in the process vessel 19 so that the operator may operate the positive closure valve 1 or not as is desired. Any mercury level indicator can be used, and not just a dip tube assembly.

Figure 3:
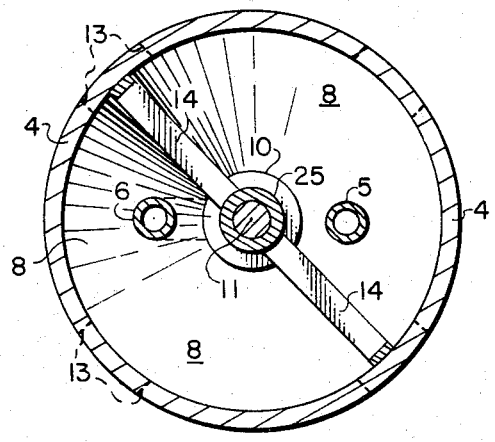
FIG. 3 is a top sectional view taken along line 3—3 of FIG. 2 and shows a water input line in cross-section, a valve stem in cross-section, and a mercury outlet line in cross-section.

FIG. 3 is a cross-sectional view of the pump assembly taken along line 3—3 of FIG. 2. The support shaft reinforcing wall 14 is shown in elevation in FIG. 3. Connecting ends of the support shaft reinforcing wall 14 are shown in cross-section just inside the annular wall of the support shaft 4.

The top of the pressure cannister top closure wall 8 is shown in FIG. 3, and the penetrating cannister pressurizing line 5 and mercury outlet line 6 are shown in cross-section. The closure valve stem 11 is shown in cross-section as well. Guiding the closure valve stem 11 is the reinforcing wall valve stem support sleeve 25 which is also shown in cross-section. The outermost edges of the closure valve head 10 are shown in FIG. 3.

In operation, the positive closure valve 1 is in its closed position, that is, the closure valve head 10 is seated in the valve seat 26. A slurry receipt adjustment tank requires that the volume of the mercury sump pit 7 be approximately 3 gallons. This figure overstates the total average volume per batch of mercury produced by the present process which will be approximately 1.5 pounds per hour which is equivalent to 1.131 gallons per batch. This is sufficiently lower than the 3 gallons volume of the mercury sump pit 7 to accomodate possible higher mercury production.

The average batch is processed over an approximately 86-hour interval of time. Mercury will be produced on the average from several sources. In a first source, a sludge receipt adjustment tank supplies 1.12 gallons per batch on average. A second source, a slurry mix evaporator, will supply approximately 0.009 gallons per batch. Finally, a third source of mercury is from a slurry mix evaporator condensate tank which will supply approximately 0.002 gallons per batch. Mercury may accumulate elsewhere in the process and will be transferred by the same pumping method. The mercury produced from these three sources will be pumped directly or indirectly to a mercury water wash tank and then by the same pumping method, to a mercury processing cell.

The specific gravity of mercury is about 13.5, as compared to the slurry feeds, or frit feeds which have a specific gravity of less than 2.0. The process vessels used in the chemical process of the preferred embodiment of the present invention cannot be penetrated on the bottom or sidewalls, since the fluid materials contained in the process vessel 19 cannot be allowed to leak as might be the case if the process vessels were penetrated on the bottom or sidewalls. Furthermore, the pump assembly of the present invention could not be made movable while a slurry is in place in the process vessel 19 if the process vessel 19 were penetrated on the bottom or sidewalls with the pump assembly since the slurry would leak out. Therefore, an important advantage of the present invention is realized in that hazardous or dangerous chemicals may be safely processed since gravity holds the chemicals in the lower portion of the process vessel 19, with the pump assembly being removable from the top of the process vessel 19. Here, also for safety, the process vessels cannot be pressurized above atmospheric pressure. This prevents escape of potentially hazardous materials from the process vessel 19.

In the present invention, formic acid is added to tank farm sludge to reduce mercuric compounds to elemental mercury which then settles to the bottom of the tank as reduction proceeds. Due to the high specific gravity of mercury, the mercury will accumulate at the low point which is the mercury sump pit 7. A pressure cannister 3 is placed within the mercury sump pit 7 to collect mercury. The mercury falls by gravity and flows through the opening defined by the valve seat 26. Mercury will displace other process materials as it settles in the pressure cannister 3. After a predetermined level of mercury is reached within the cannister, as indicated by the dip tube assembly 30, the positive closure valve 1 is closed with sealing being assured by the proper valve seat angle and sufficient closing force. The pressure cannister 3 is then pressurized with water to 300 p.s.i.g. maximum, forcing the accumulated mercury out of the tank by the mercury outlet line 6 to a downstream vessel (not shown). This pressurizing process may be either intermittent pulsing or it may be a steady flow until mercury transfer is completed. While the positive closure valve 1 is in the open position, mercury fills the pressure cannister 3. With the positive closure valve 1 closed and the pressure canister flooded via the cannister pressurizing line 5, at 300 p.s.i.g., accumulated mercury is forced out of the pressure cannister 3 by the mercury outlet line 6. Pressure of the fluid in the cannister pressurizing line 5 is monitored by any convenient means such as a pressure gauge or the like, and when mercury transfer is completed and no substantial amount of mercury remains in the mercury outlet line 6, the inlet water pressure drops significantly. This indicates completion of transfer of mercury.

The inlet water pressure drops significantly in the cannister pressurizing line 5 due to the high specific gravity of mercury in the mercury outlet line 6. As is known in fluid mechanics, the height of a fluid column causes a pressure to exist at the bottom of the column due to the specific gravity of the liquid in the column. In this case, with mercury in the column, together with the weight of the water in the column, a very high pressure is needed to force the mercury upward through the mercury outlet line 6. However, once mercury transfer is complete, no mercury remains in the mercury outlet line 6 and therefore the high specific gravity of the mercury outlet line 6 does not contribute to the pressure at the base of the mercury outlet line 6. Thus, only the specific gravity of water contributes to the pressure at the base of the mercury outlet line 6, and it is only this pressure which must be matched by that applied to the fluid in the cannister pressurizing line 5 to displace fluid in pressure cannister 3.

In the preferred embodiment, there is no check valve or like mechanism in mercury outlet line 6 because it is deemed undesirable in the exemplary reaction being used to explain the invention to have any such devices in the process line on the basis of considerations of reliability. It will be apparent to one of ordinary skill in the art, however, that such a device could be placed in mercury outlet line 6 if different or other design considerations permitted or warranted same.

High pressure water to the cannister pressurizing line 5 is then cut off. The positive closure valve 1 is in the closed position, and the pump is ready for the next transfer.

Of course, the above-described operation leaves pressure cannister 3 full of inlet water which has displaced the accumulated mercury. This inlet water is then itself displaced by mercury admitted after re-opening of positive closure valve 1. This displaced inlet water escapes through valve seat 26 into process vessel 19, where, in general, it disperses without harming the reaction proceeding therein, as discussed below.

An important feature of the present invention is that the pump assembly is removable from the process vessel 19, even while process vessel 19 is being used to contain process chemicals. The pump assembly is removable from the process vessel 19 when the process vessel 19 is filled to any level, without requiring removal of the process chemicals from the process vessel 19. The pump assembly is removable by overhead crane in the event of a pump failure or in the event of any maintenance requirements to the pump assembly.

When the pump assembly is reinstalled, the tank may be either empty, full, or at any level inbetween. The pump is carefully lowered through the process vessel annular wall tank flange opening 9 until the pressure cannister 3 slips into the mercury sump pit 7 at the bottom of the process vessel 19.

Inlet water admitted into the pressure cannister 3, if mixed in a relatively small amount with the contents of the process vessel 19, is not generally harmful to the reaction in the process vessel 19.

The improved water displacement mercury pump of the present invention is capable of achieving the above-enumerated objects and while preferred embodiments of the present invention have been disclosed, it will be understood it is not limited thereto but may be otherwise embodied within the scope of the following claims.

What is claimed is:

1. A pump for displacing a heavier fluid by a lighter fluid, comprising:

a heavier fluid;

a lighter fluid;

a process vessel adapted to receive a cannister;

a cannister adapted to receive fluid under pressure and further adapted to be received within a process vessel;

said cannister having a top wall;

said top wall having an opening therein which is adapted to serve as a valve seat and which is further adapted to permit passage of fluid therethrough;

a fluid inlet conduit which extends through said top wall and which is fixedly attached thereto along an outer peripheral portion of said fluid inlet conduit such that a leak resistant barrier is formed between the outer periphery of said fluid inlet conduit and said top wall;

a fluid outlet conduit passing through said top wall and being fixedly secure along the outer periphery of said fluid outlet conduit to said top wall such that a pressurized barrier is formed between the outer periphery of said fluid outlet conduit and said top wall;

a valve head adapted to move into fluid-tight engagement with said valve seat in said top wall;

said valve head being movable by a valve stem;

a means for moving said valve stem to operate said valve head selectively into engagement with said valve seat; and a support shaft fixedly attached to said top wall;

said support shaft extending away from said top wall and enclosing said fluid inlet conduit, said fluid outlet conduit, and said valve stem;

said support shaft being fixedly attached to a pump top closure wall;

whereby said lighter fluid can be introduced under pressure into said cannister through said fluid inlet conduit with sufficient pressure to displace said heavier fluid from said cannister through said fluid outlet conduit and above said top wall of said cannister, when said valve head is seated in said valve seat; and whereby said cannister, said fluid inlet conduit, said fluid outlet conduit, said valve stem, and said valve head are removable from said process vessel by movement of said support shaft out of said process vessel.

2. A displacement pump as claimed in claim 1, wherein said cannister has a lower surface which is tapered and is formed generally as a surface of revolution.

3. A displacement pump as claimed in claim 2, wherein said process vessel at its lowermost portion forms a sump pit which tapers inwardly with depth and which is adapted to receive said cannister;

whereby lowering of said cannister into said process vessel is guided by the tapering fit between said cannister bottom and said sump pit which receives said cannister bottom.

4. A displacement pump as claimed in claim 3, wherein said heavier fluid is mercury and;

said lighter fluid is water;

whereby mercury formed as a product of a reaction in said process vessel settles to the bottom of said process vessel and flows into said cannister through said valve seat when said valve head is in an open position; and whereby said lighter fluid can displace said heavier fluid through said fluid outlet conduit when said valve head is in a closed position.

* * * * *